US007748337B2

(12) United States Patent
Doyle

(10) Patent No.: US 7,748,337 B2
(45) Date of Patent: Jul. 6, 2010

(54) AUTOMATIC BOAT WASHING ASSEMBLY

(76) Inventor: Keith Doyle, 3948 Ridgewood Rd., York, PA (US) 17402

( * ) Notice: Subject to any disclaimer, the term of this patent is extended or adjusted under 35 U.S.C. 154(b) by 140 days.

(21) Appl. No.: 12/044,305

(22) Filed: Mar. 7, 2008

(65) Prior Publication Data

US 2008/0216732 A1 Sep. 11, 2008

Related U.S. Application Data

(60) Provisional application No. 60/893,707, filed on Mar. 8, 2007.

(51) Int. Cl.
*B63B 59/00* (2006.01)

(52) U.S. Cl. ..... 114/222

(58) Field of Classification Search ..... 114/222
See application file for complete search history.

(56) References Cited

U.S. PATENT DOCUMENTS

| | | | | | |
|---|---|---|---|---|---|
| 3,561,391 | A | | 2/1971 | Locati | |
| 3,628,489 | A | * | 12/1971 | Michaelsen | 114/222 |
| 3,800,732 | A | | 4/1974 | Hill | |
| 4,007,701 | A | * | 2/1977 | Fike | 114/222 |
| 4,043,286 | A | | 8/1977 | Doty | |
| 4,046,095 | A | | 9/1977 | Fike | |
| 4,236,477 | A | * | 12/1980 | Norris et al. | 114/222 |
| 4,401,048 | A | | 8/1983 | Rogers | |
| 4,658,749 | A | * | 4/1987 | Penalba | 114/222 |
| 4,784,078 | A | * | 11/1988 | Feurt | 114/222 |
| 4,843,995 | A | | 7/1989 | Bingham | |
| 5,222,452 | A | | 6/1993 | Maloney et al. | |
| 5,351,640 | A | | 10/1994 | Attaway et al. | |
| 5,638,764 | A | | 6/1997 | Sarvela | |
| 6,067,921 | A | | 5/2000 | Weber | |
| 6,327,991 | B1 | | 12/2001 | Eichert | |
| 2004/0133999 | A1 | | 7/2004 | Walton | |

* cited by examiner

*Primary Examiner*—Stephen Avila
(74) *Attorney, Agent, or Firm*—Alan G. Towner, Esq.; Pietragallo Gordon Alfano Bosick & Raspanti, LLP

(57) ABSTRACT

An automatic boat washing system including several brush assemblies mounted on a vertically movable cage supported by a mainframe assembly and side ballast tanks is disclosed. The vertical position of the movable cage and brush assemblies may be adjusted in relation to the mainframe and ballast tanks during operation of the system. Rollers are used for supporting and drawing boats through the automatic boat washing assembly. The automatic boat washing assembly of the present invention may be used to clean powerboats in areas below the waterline in order to improve boat performance.

20 Claims, 15 Drawing Sheets

AUTOMATIC BOAT WASHING ASSEMBLY

CROSS-REFERENCE TO RELATED APPLICATION

This application claims the benefit of U.S. Provisional Application No. 60/893,707 filed Mar. 8, 2007, which is incorporated herein by reference.

FIELD OF THE INVENTION

The present invention relates to boat washers, and more particularly relates to an automatic boat washing assembly.

BACKGROUND INFORMATION

Boat hulls need to be periodically washed to remove debris such as algae, bacteria, barnacles, minerals, oil, dirt and other marine materials. Various types of boat washing devices have been proposed. However, a need still exists for an automatic boat washing system that effectively cleans boat hulls and is easy to use and operate.

SUMMARY OF THE INVENTION

The present invention provides an automatic boat washing system including several brush assemblies mounted on a vertically movable cage supported by a mainframe assembly and side ballast tanks. The vertical position of the movable cage and brush assemblies may be adjusted in relation to the mainframe and ballast tanks during operation of the system. Rollers are used for supporting and drawing boats through the automatic boat washing assembly. The automatic boat washing assembly may be used to clean powerboats in areas at and below the waterline in order to improve boat performance. Typical boats that may be cleaned are inboard and inboard/outboard stern drive boats having beams of from about 8 to about 13.5 feet.

An aspect of the present invention is to provide an automatic boat washing assembly comprising: a main frame including side frames having at least one generally vertical guide member, a movable cage located between the side frames and contacting the at least one generally vertical guide member, wherein the height of the movable cage with respect to the main frame is adjustable, a plurality of brush assemblies mounted on the movable cage structured and arranged to contact and clean a boat as it passes through the boat washing assembly, and a plurality of keel drive assemblies mounted on the movable cage structured and arranged to contact the keel of the boat and to move the boat through the boat washing assembly.

This and other aspects of the present invention will be more apparent from the following description.

DETAILED DESCRIPTION

Figure 1:
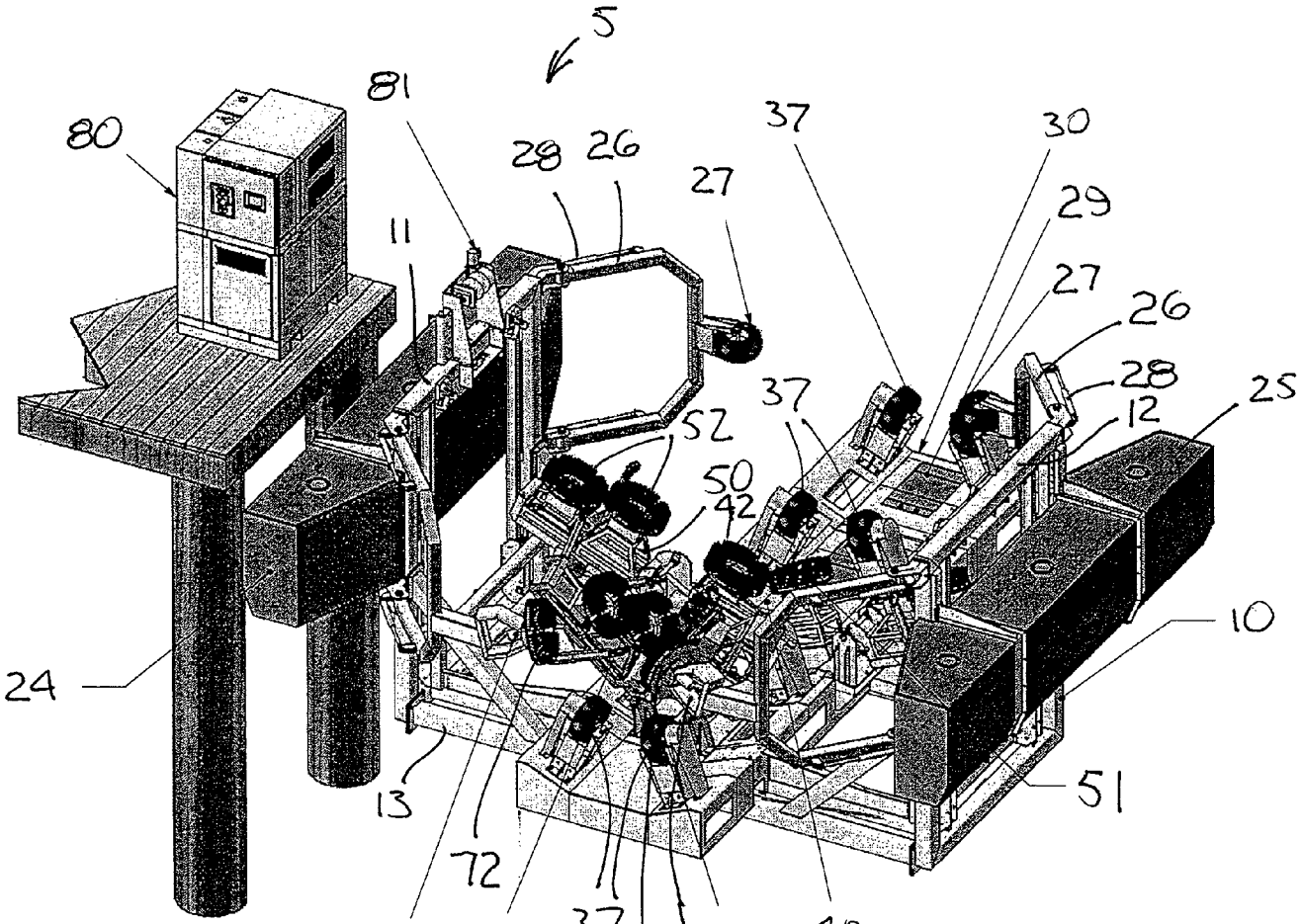
FIG. 1 is an isometric view of an automatic boat washing assembly in accordance with an embodiment of the present invention.
Figure 2:
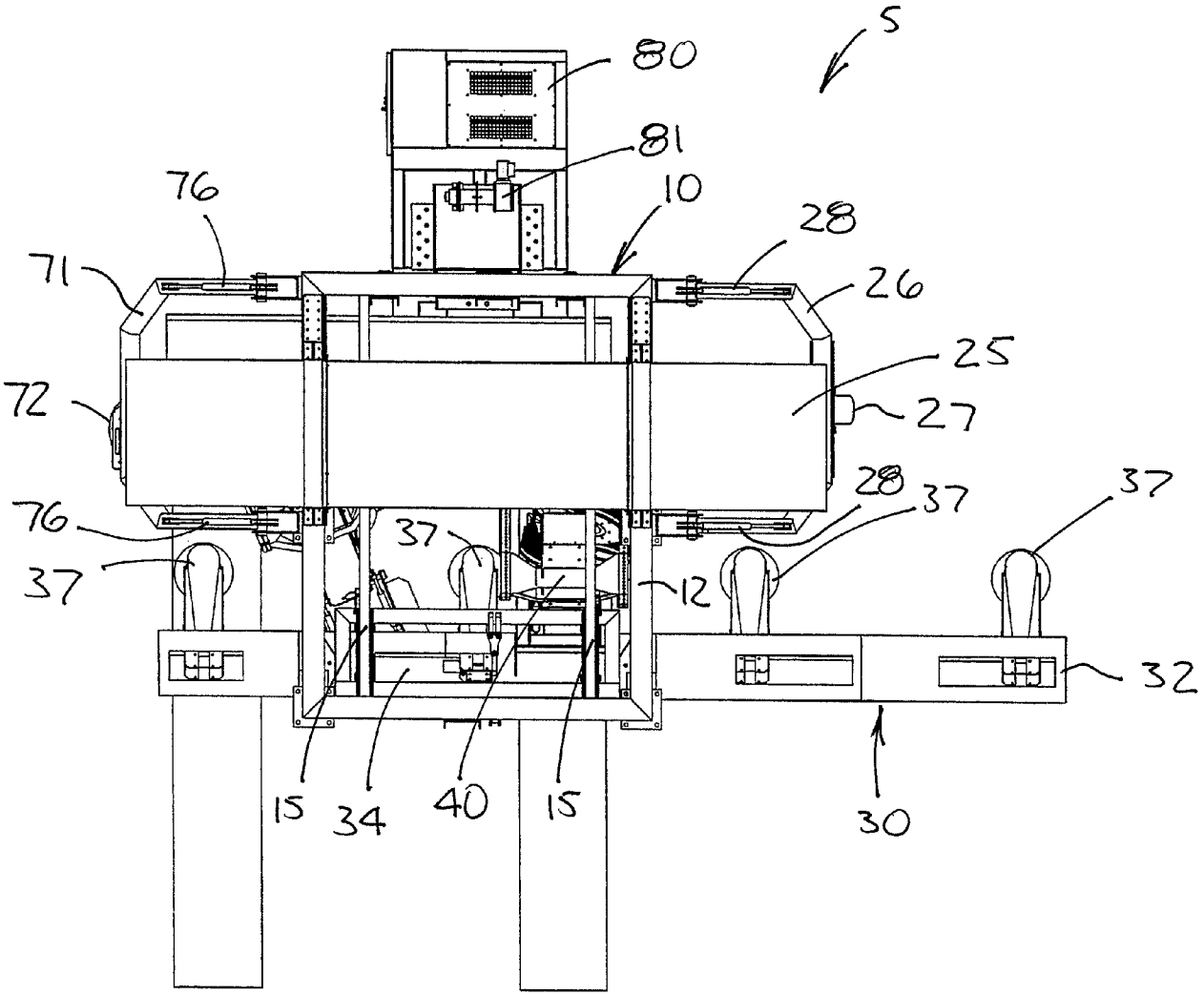
FIG. 2 is a side view of the automatic boat washing assembly of FIG. 1.

FIGS. 1-4 illustrate an automatic boat washing assembly 5 in accordance with an embodiment of the present invention. The boat washing assembly 5 includes a main frame 10 including generally vertical side frames 11 and 12 connected at their lower ends by a base frame 13. A vertically movable cage 30 upon which several brush assemblies 40, 50, 51, 60 and 61 are mounted is adjustably supported by the main frame 10.

Figure 5:
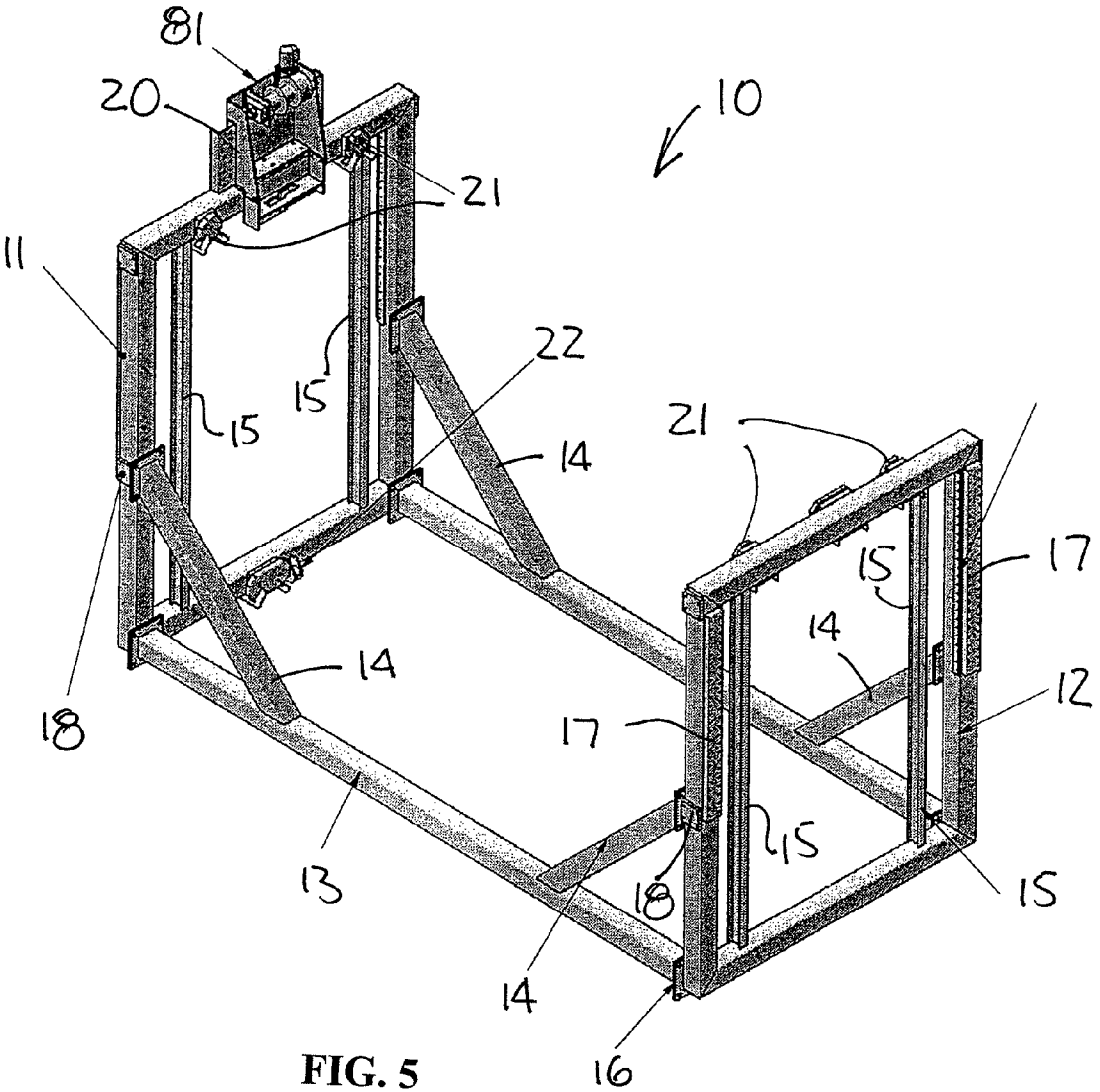
FIG. 5 is an isometric view of a main frame of an automatic boat washing assembly in accordance with an embodiment of the present invention.
Figure 6:
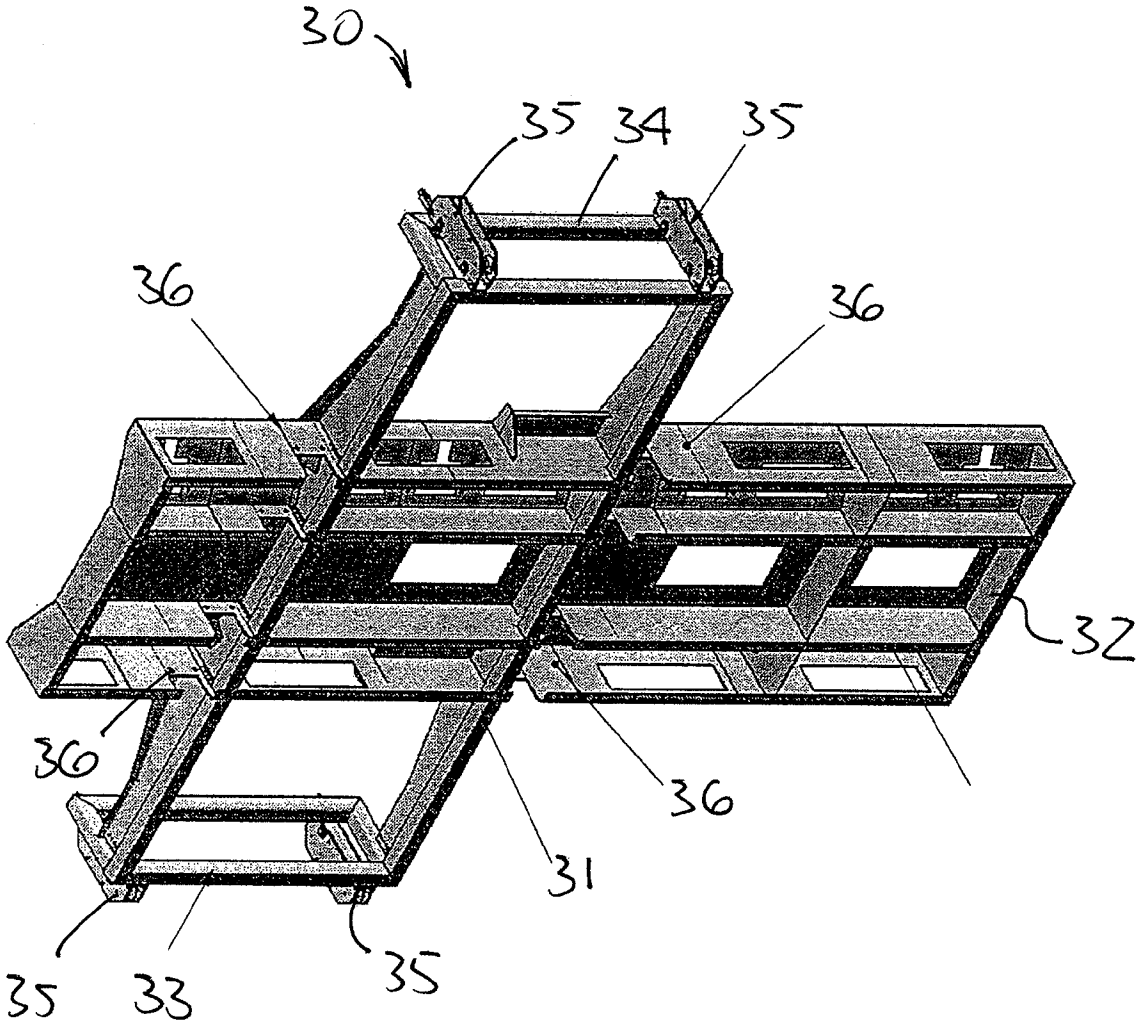
FIG. 6 is a bottom isometric view of a vertically movable cage of an automatic boat washing assembly in accordance with an embodiment of the present invention.
Figure 9:
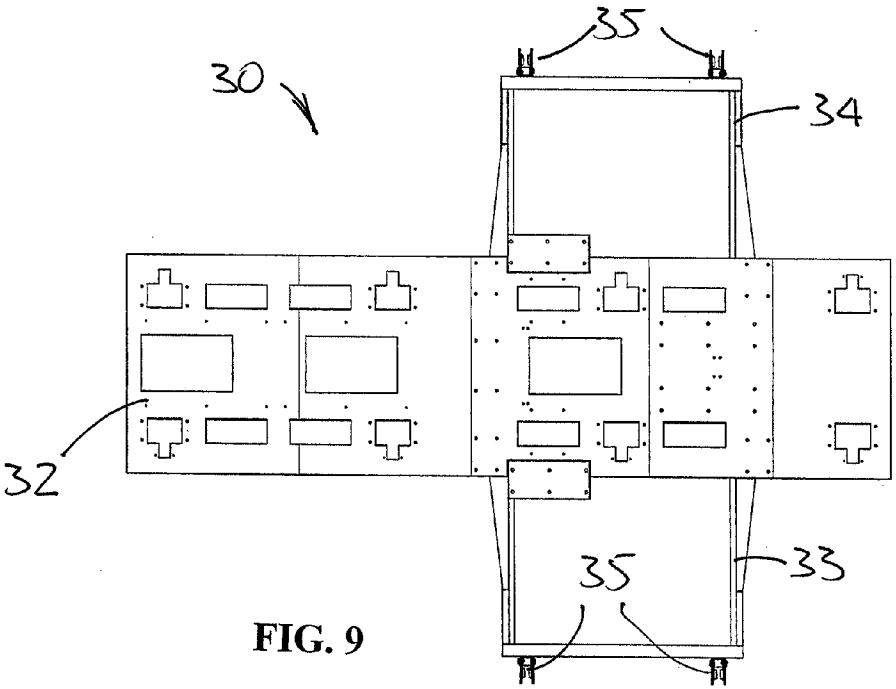
FIG. 9 is a top view of the movable cage of FIG. 6.
Figure 8:
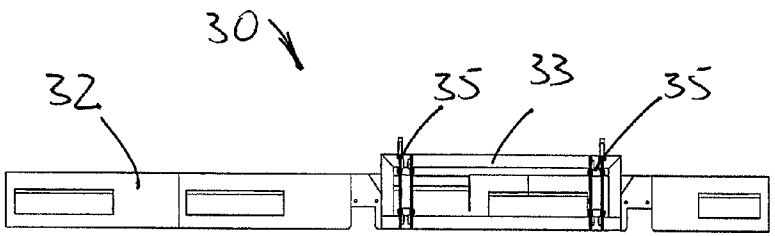
FIG. 8 is a side view of the movable cage of FIG. 6.
Figure 7:
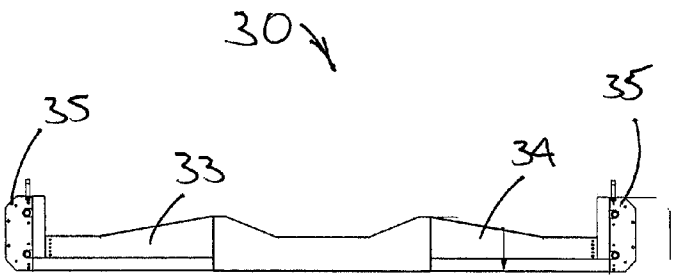
FIG. 7 is an end view of the movable cage of FIG. 6.

As shown most clearly in FIG. 5, the main frame 10 includes gussets 14 connected between each of the side frames 11 and 12 and the base frame 13. Two vertical cam follower guides 15 are mounted on each of the side frames 11 and 12. The side frames 11 and 12, base frame 13, gussets 14 and cage guides 15 are typically made of metal such as steel and are connected to each other by any suitable means such as welding and mechanical fasteners. In the embodiment shown in FIG. 5, several disconnectable shipping split connections 16 are provided between each of the side frames 11 and 12 and the base frame 13 and gussets 14, which allow for easier transportation of the main frame 10. The main frame 10 also includes ballast tank mounting bars 17, as well as mounting plates 18 for bow guide assemblies 26 and waterline brush assemblies 70 and 71, as described in more detail below.

FIG. 5 also illustrates a winch mounting plate 20 secured to the top of the side frame 11. Several sheaves 21 are provides on the main frame 10 for guiding wire rope which is used in conjunction with a winch to adjust the height of the movable cage 30, as more fully described below.

As shown in FIGS. 1-4, ballast tanks 24 and 25 are provided on opposite sides of the main frame 10 and connected to the side frames 11 and 12. Bow guides assemblies 26 including bow guide wheels 27 and gas-assisted springs 28 are pivotally connected to the side frames 11 and 12 of the main frame 10.

As shown in FIGS. 1-4 and 6-9, the automatic boat washing assembly 5 includes a cage 30 that is vertically movable with respect to the main frame 10. The vertically movable cage 30 includes a lateral undercarriage 31 section and a longitudinal undercarriage 32 section. The lateral undercarriage 31 section includes laterally extending arms 33 and 34 having cam followers 35 mounted at the ends thereof. A ballast tank 29 may be provided near one end of the longitudinal undercarriage section 32 in order to help maintain the cage 30 in a horizontal orientation during the cleaning operation. As shown most clearly in FIG. 6, several disconnectable shipping split connections 36 may be provided between the lateral and longitudinal undercarriage sections 31 and 32, which allow for easier transportation of the movable cage 30 in a disassembled condition.

Figure 10:
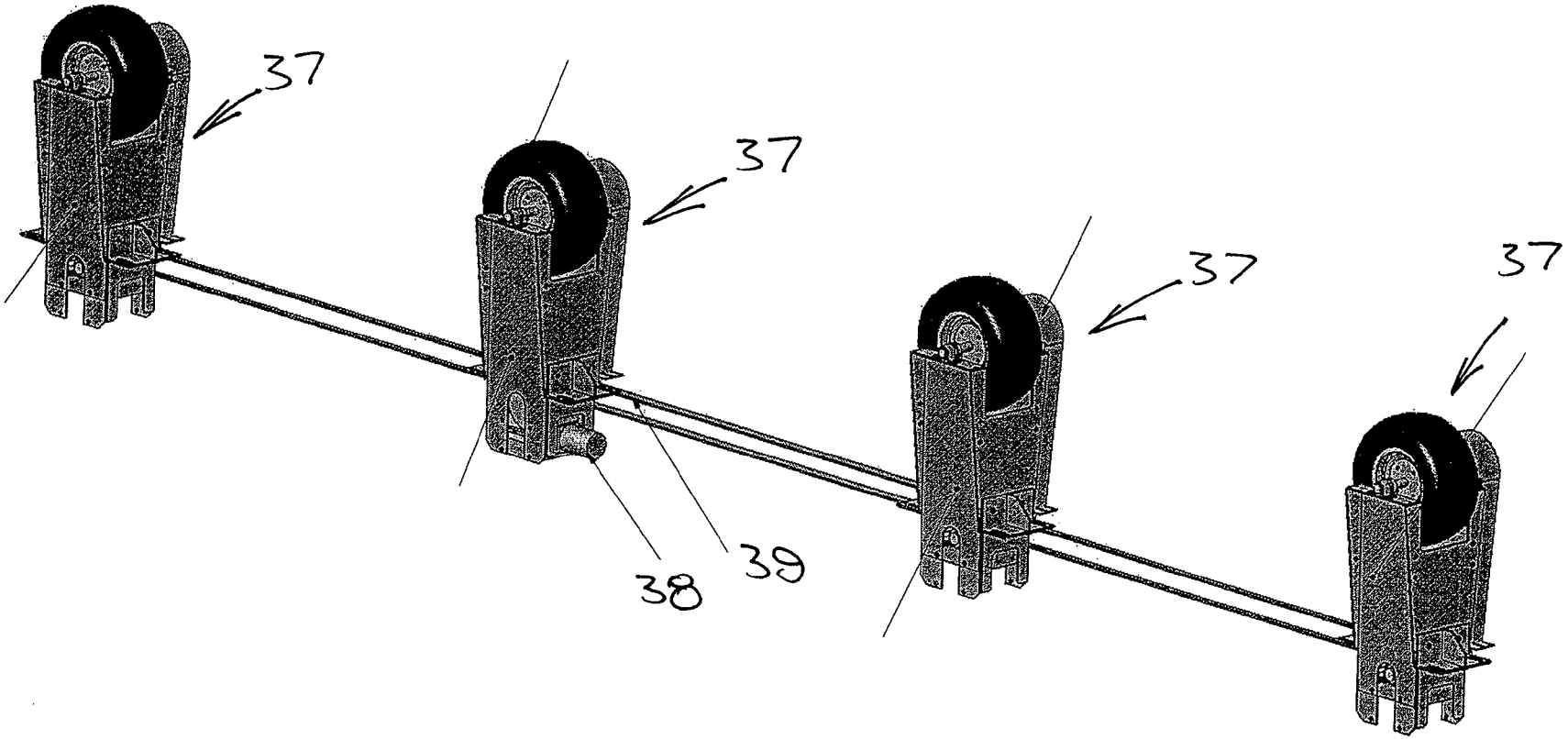
FIG. 10 is an isometric view of a portion of a keel drive system including multiple keel drive wheels mounted in housings in accordance with an embodiment of the present invention.

As shown in FIGS. 1-4 and 10, keel drive assemblies 37 comprising wheels rotatably mounted on housings are mounted on the longitudinal undercarriage 32 of the movable cage 30. In the embodiment shown, two sets of four wheels are provided on opposite sides of the central longitudinal axis of the longitudinal undercarriage 32 in order to contact the keel of a boat and move it through the assembly 5. As shown in FIG. 10, each keel drive assembly includes a series of housings and their associated wheels. A hydraulic motor 38 is provided at the base of at least one of the keel drive assemblies 37. The motor 38 drives a continuous drive belt 39 connected between all of the assemblies 37 in order to drive the wheels of the assemblies and/or to drive brush assemblies mounted on or near the assemblies 37.

Figure 3:
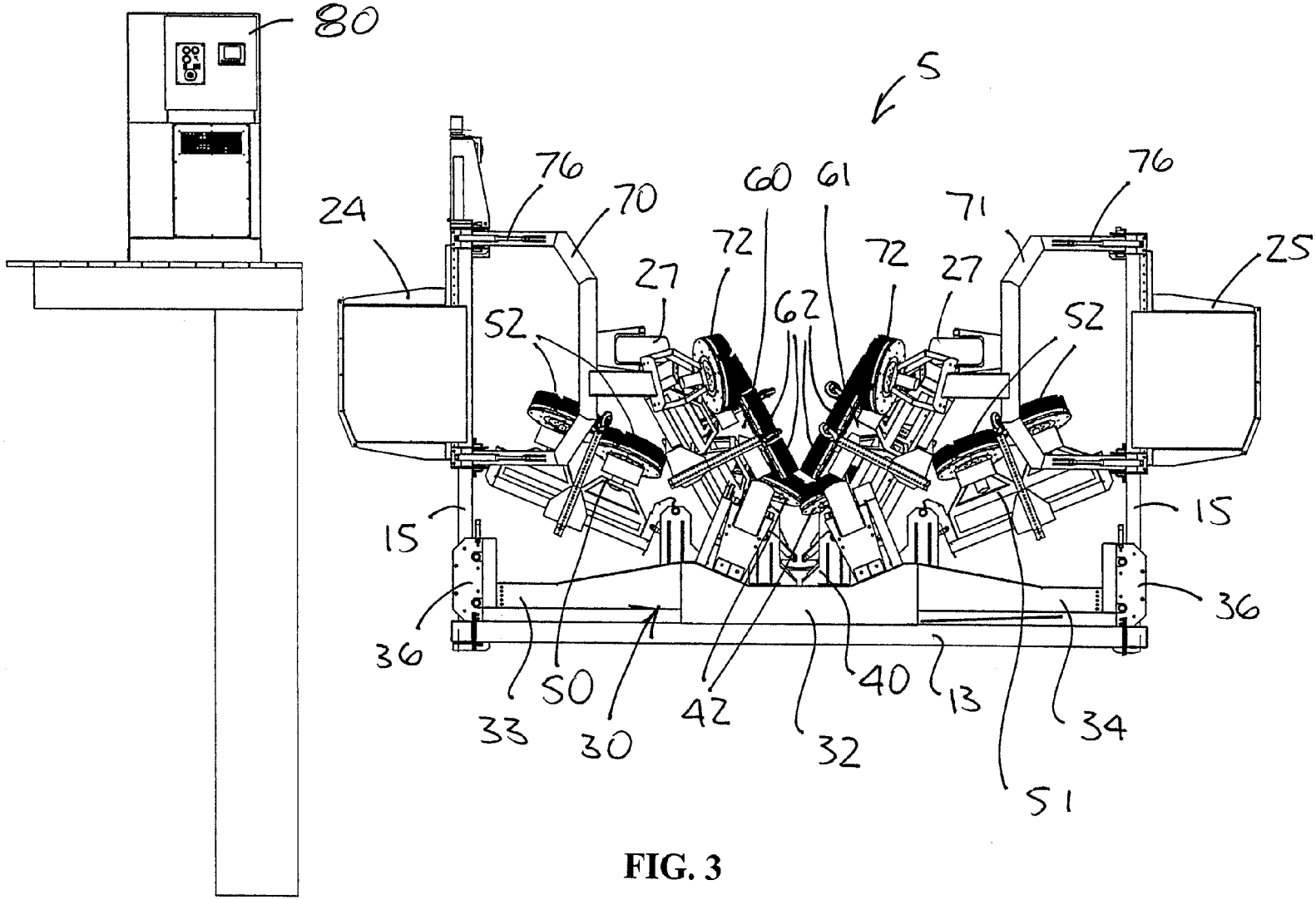
FIG. 3 is an end view of the automatic boat washing assembly of FIG. 1.
Figure 4:
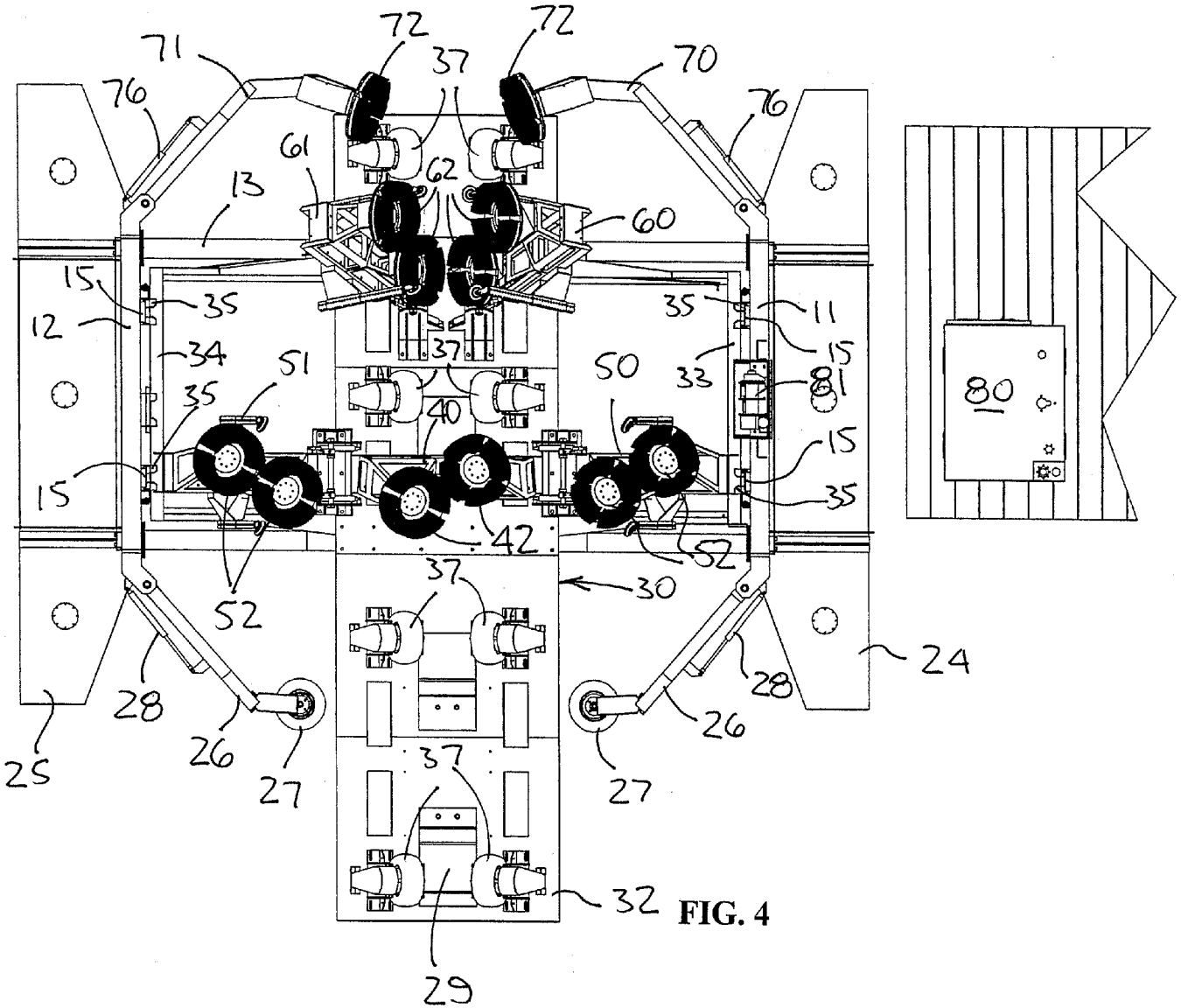
FIG. 4 is a top view of the automatic boat washing assembly of FIG. 1.

As shown most clearly in FIGS. 1, 3 and 4, several brush assemblies are mounted on the movable cage 30. A keel brush assembly 40 including two disk-shaped rotary keel brushes 42 is mounted near the center of the movable cage 30. Opposing mid brush assemblies 50 and 51 are mounted above the lateral arms 33 and 34 of the movable cage 30. Each mid brush assembly 50 and 51 includes two disk-shaped rotary mid brushes 52. Opposing bow brush assemblies 60 and 61 are also mounted on the movable cage 30. Each bow brush assembly 60 and 61 includes two disk-shaped rotary bow brushes 62. Opposing waterline brush assemblies 70 and 71 are mounted on the side frames 11 and 12 of the main frame 10. Each waterline brush assembly 70 and 71 includes a single disk-shaped rotary waterline brush 72. The rotary brush assemblies are described in more detail below.

Figure 11:
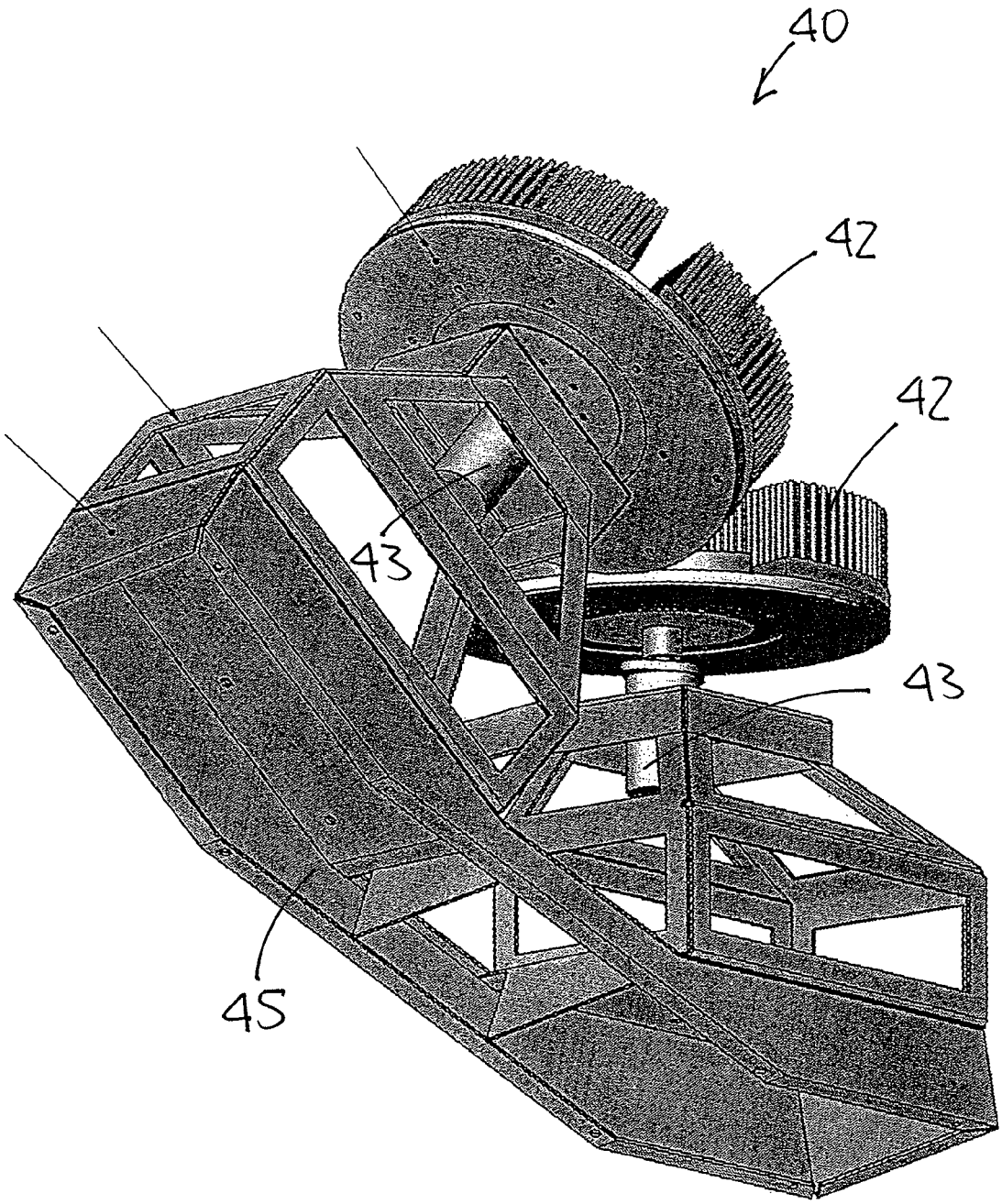
FIG. 11 is an isometric view of a keel brush assembly in accordance with an embodiment of the present invention.

As shown in FIG. 11, the keel brush assembly 40 includes two rotary brushes 42, each of which is powered by a hydraulic motor 43. The rotary brushes 42 are mounted on a frame 45 which is fastened to the movable cage 30.

Figure 12:
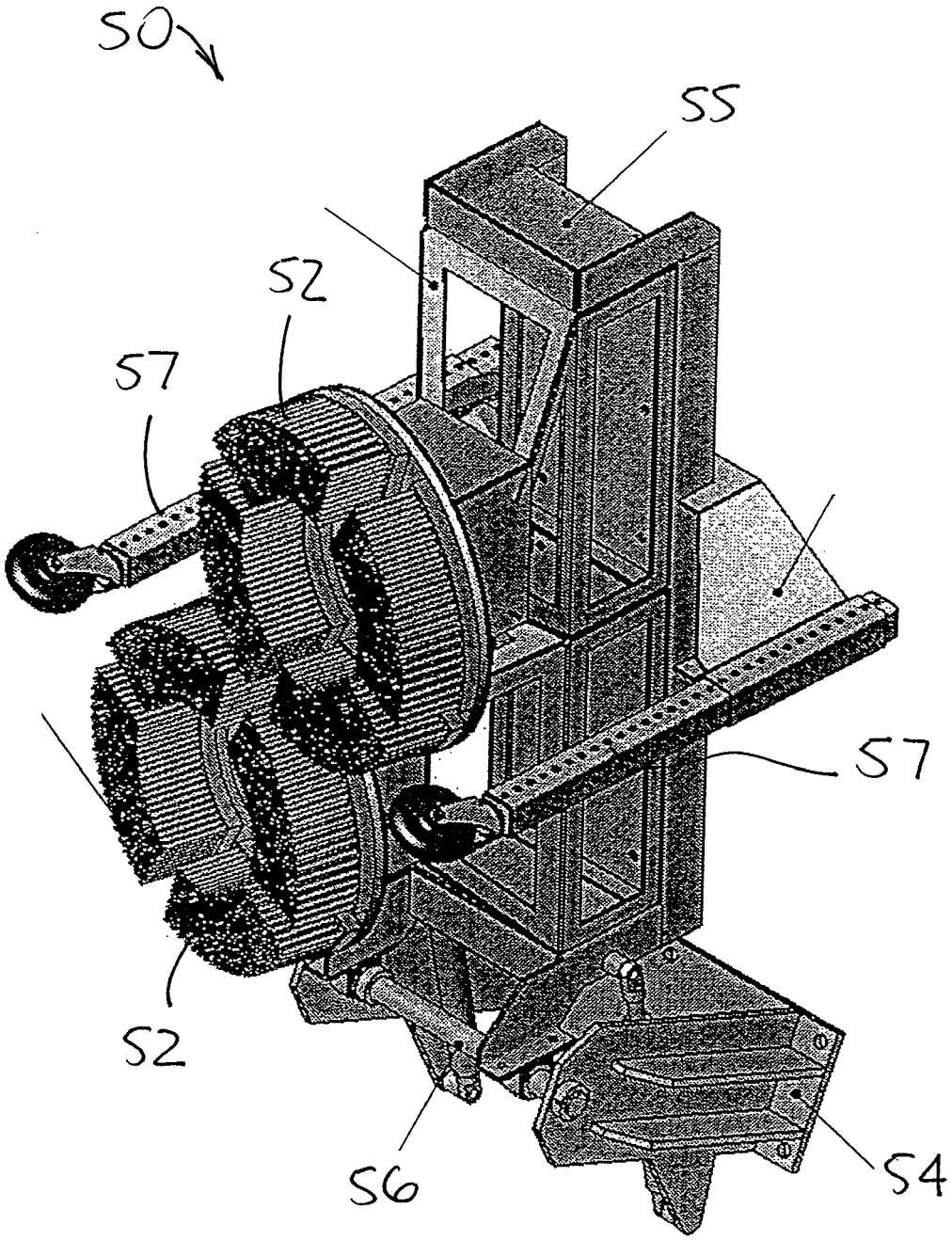
FIG. 12 is an isometric view of a mid brush assembly in accordance with an embodiment of the present invention.

As shown in FIG. 12, the mid brush assembly 50 includes two rotary brushes 52 powered by hydraulic motors (not shown). The assembly 50 includes a base 54 mountable on the movable cage 30 and a frame 55 pivotally mounted on the base 54. Gas-assisted springs 56 are used to move and bias the frame 55 and rotary brushes 52 against the mid section of a boat hull during the cleaning operation. Adjustable wheeled outriggers 57 are used to help position the rotary brushes 52 in relation to the boat hull during the cleaning operation.

Figure 13:
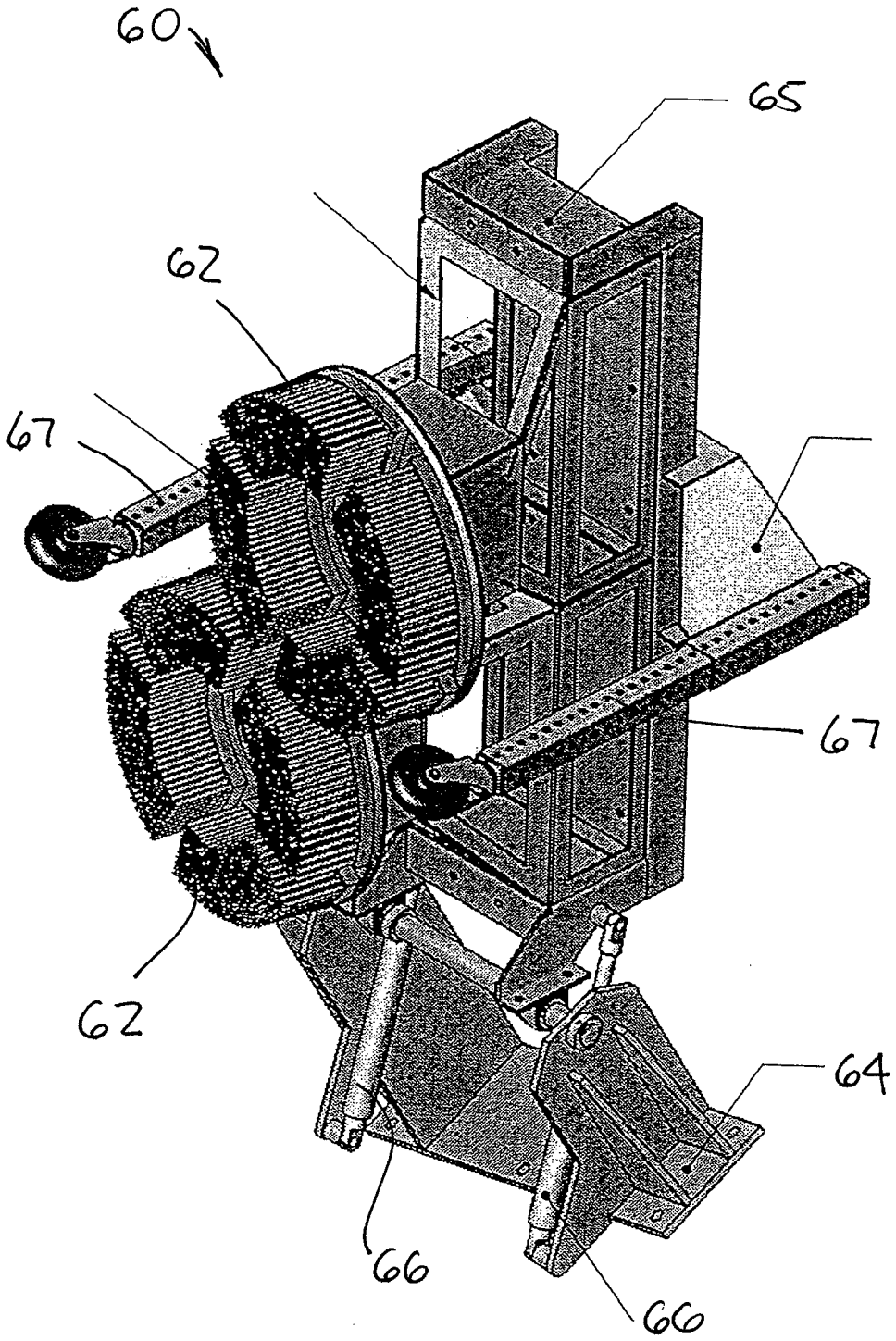
FIG. 13 is an isometric view of a bow brush assembly in accordance with an embodiment of the present invention.

As shown in FIG. 13, the bow brush assembly 60 includes two rotary brushes 62 powered by hydraulic motors (not shown). The assembly 60 includes a base 64 mountable on the movable cage 30 and a frame 65 pivotally mounted on the base 64. Gas-assisted springs 66 are used to pivotally move and bias the frame 65 and rotary brushes 62 against the bow of a boat during the cleaning operation. Adjustable wheeled outriggers 67 are used to help position the rotary brushes 62 in relation to the boat hull.

Figure 14:
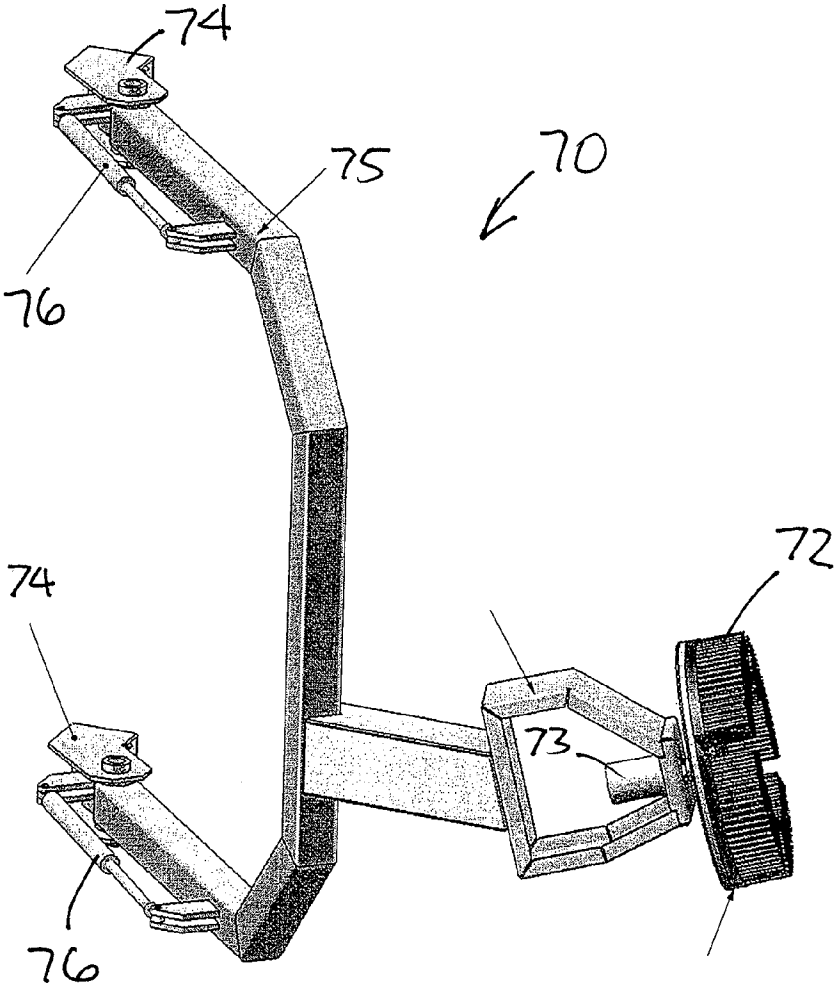
FIG. 14 is an isometric view of a waterline brush assembly in accordance with an embodiment of the present invention.

As shown in FIG. 14, the waterline brush assembly 70 includes a rotary brush 72 driven by a hydraulic motor 73. The assembly 70 includes mounting brackets 74 which are mounted on the side frame 11 of the main frame 10. A rotary brush frame 75 is pivotally mounted on the mounting brackets 74, and gas-assisted springs 76 are used to move and bias the frame 75 and rotary brush 72 in the desired position against the waterline of the boat hull during the cleaning operation.

Figure 15:
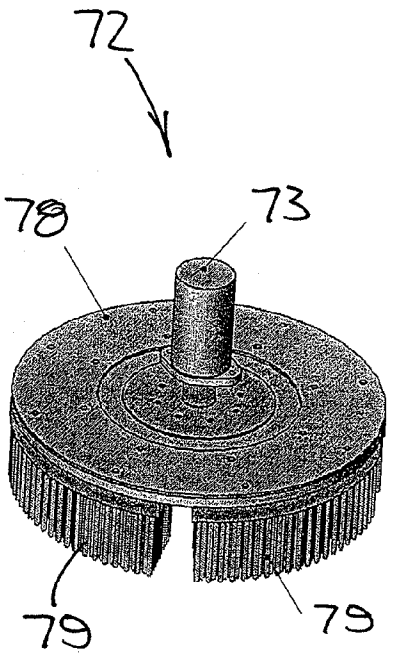
FIG. 15 is an isometric view of a rotary brush in accordance with an embodiment of the present invention.

FIG. 15 illustrates one of the rotary brushes 72 driven by the hydraulic motor 73. The rotary brush 72 includes an elastomeric backing disk 78 onto which multiple brush segments 79 are mounted. In the embodiment shown, the rotary brush 72 has four brush segments 79, each of which extends approximately 90 degrees around the circumference of the backing disk 78 brush. The brush segment 79 includes bristles made of any suitable material such as polypropylene. The other rotary brushes 42, 52 and 72 may be constructed similarly to the rotary brushes 72. However, in some circumstances, it may be desirable to use different types of brushes on the different brush assemblies.

As shown in FIG. 1, a controller 80 is used to control the operation of the automatic boat washing assembly 5. A winch assembly 81 drives a wire rope that is used to adjust the vertical position of the movable cage 30 in relation to the main frame 10, as more fully described below. The controller 80 comprises conventional circuitry and may be programmed by means known in the art to operate the automatic boat washing assembly, e.g., to run the keel drive assemblies 37, raise and lower the winch 81, and run the brush assemblies 40, 50, 51, 60, 61, 70 and 71. In one embodiment, the controller 80 may be powered by a diesel or gas generator in order to avoid running electrical lines thereto.

Figure 16:
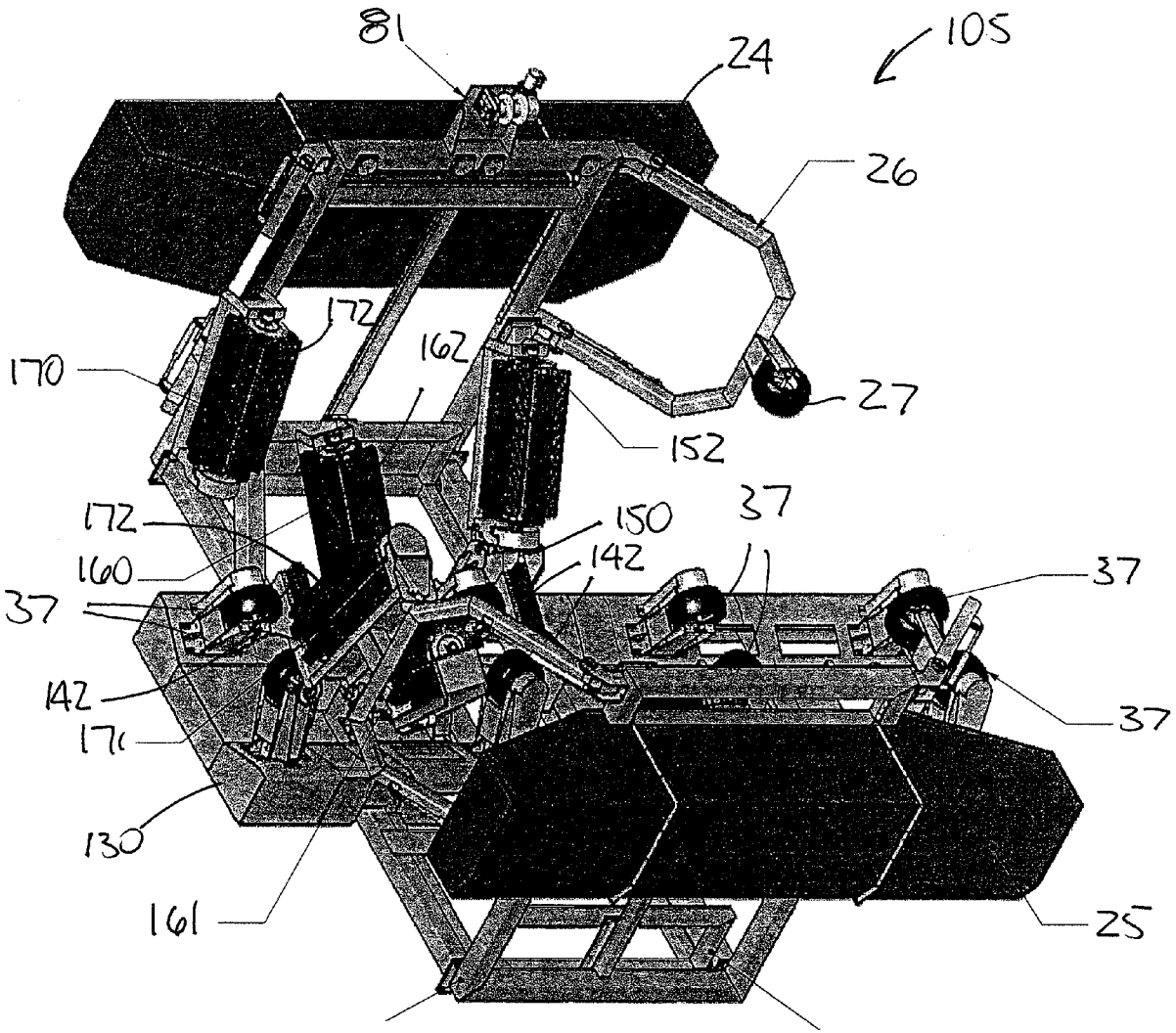
FIG. 16 is an isometric view of an automatic boat washing assembly in accordance with another embodiment of the present invention similar to that shown in FIG. 1 but equipped with roller brush assemblies instead of rotary brush assemblies.
Figure 17:
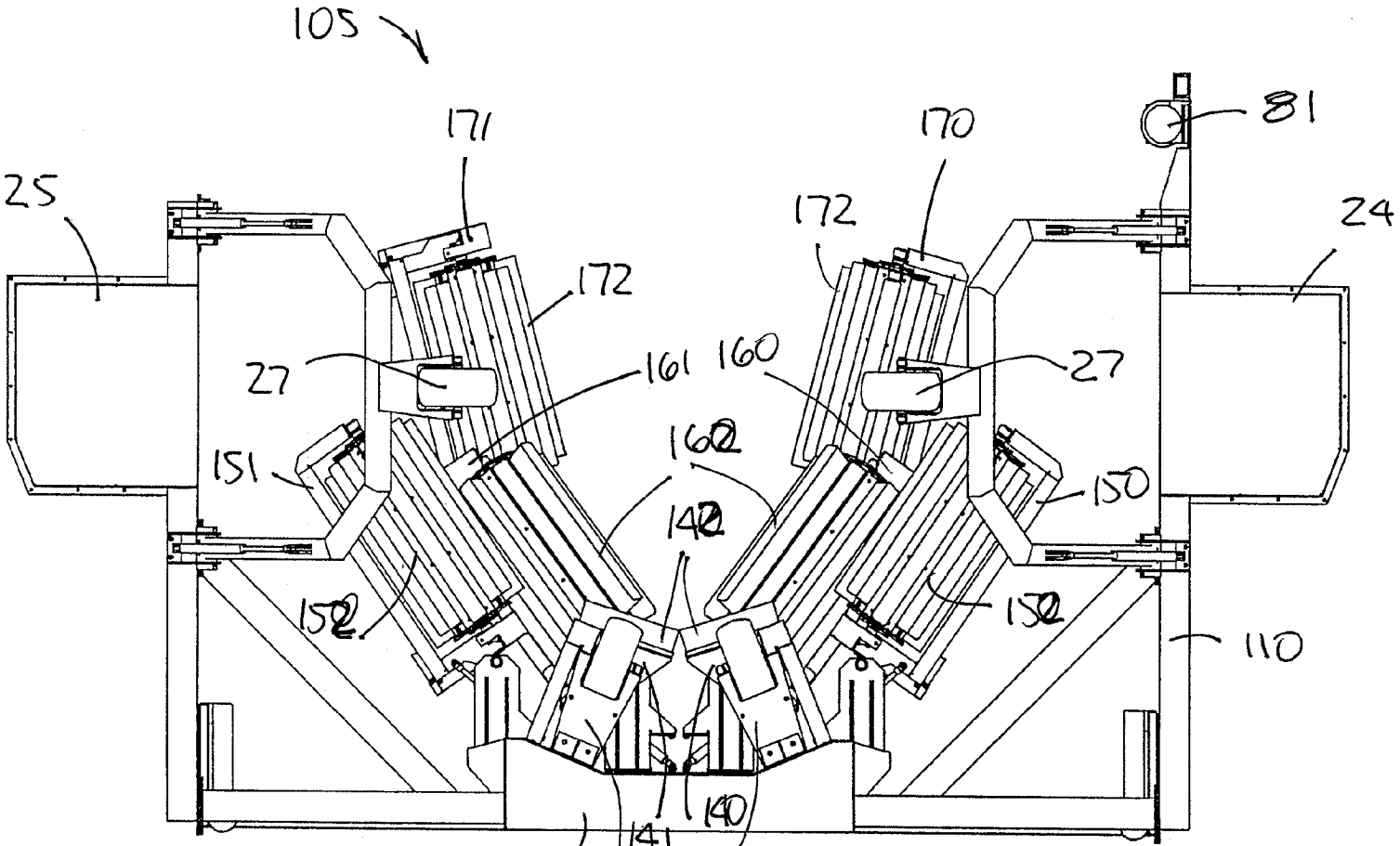
FIG. 17 is an end view of the automatic boat washing assembly of FIG. 16.
Figure 18:
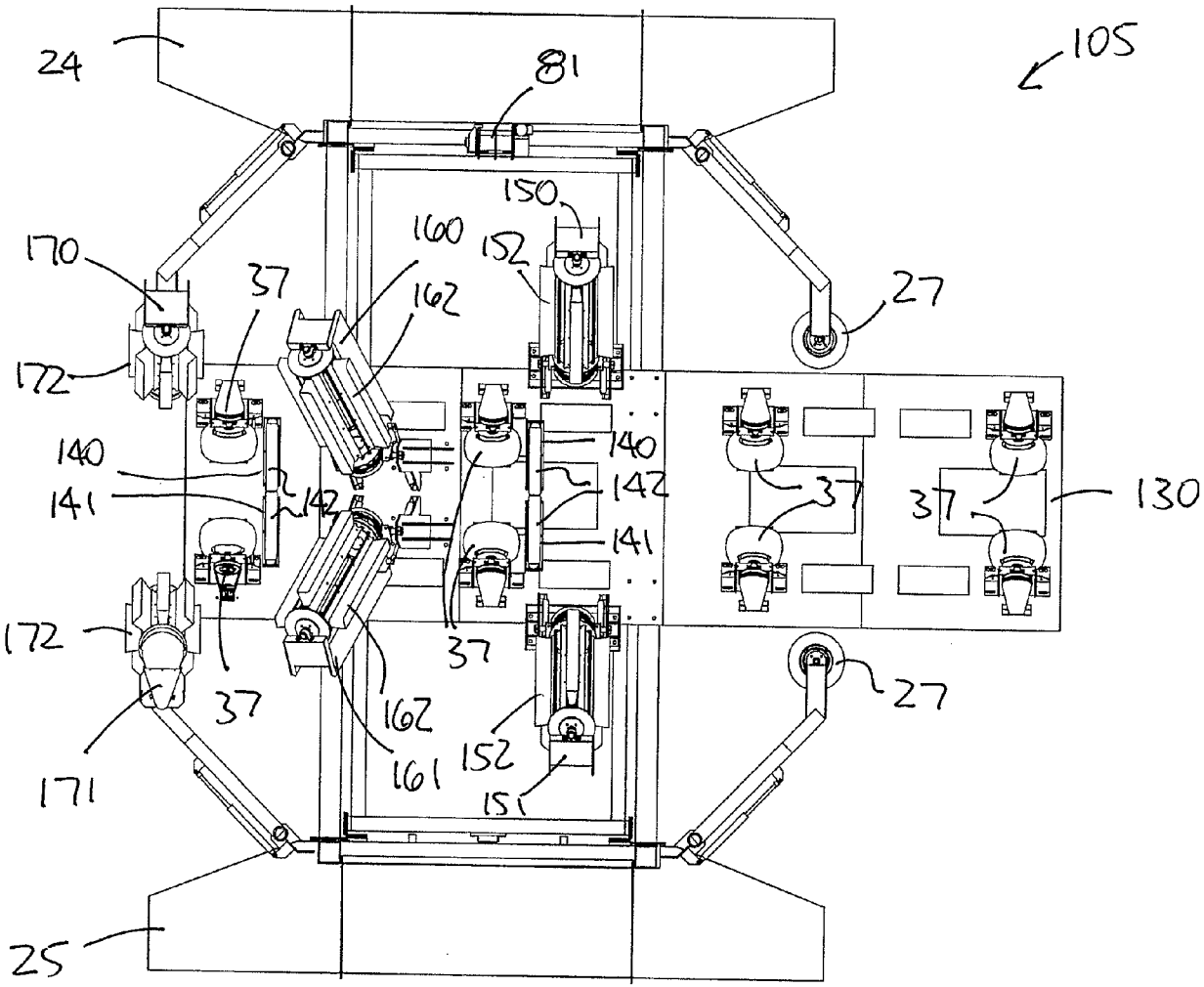
FIG. 18 is a top view of the automatic boat washing assembly of FIG. 16.

FIGS. 16-18 illustrate another automatic boat washing assembly 105 in accordance with an embodiment of the present invention. The automatic boat washing assembly 105 shown in FIGS. 16-18 is similar to that shown in FIGS. 1-4, except several of the disk-shaped rotary brush assemblies have been replaced with roller brushes. The automatic boat washing assembly 105 includes a main frame 110 and vertically movable cage 130. A series of stationary keel brushes 140 and 141 are mounted on the movable cage 130 adjacent to two of the keel drive assemblies 37. Opposing mid brush assemblies 150 and 151 are mounted on the movable cage 130. Each mid brush assembly 150, 151 includes a single roller brush 152 having multiple rows of bristles located around the circumference of the brush. Bow brush assemblies 160 and 161 are also mounted on the movable cage 130, each of which comprises a roller brush 162. Opposing waterline brush assemblies 170 and 171 are mounted on opposing sides of the main frame 110. Each waterline brush assembly 170 and 171 includes a roller brush 172. In the embodiment shown in FIGS. 16-18, three sets of hydraulically driven roller brushes and two sets of fixed position brushes clean the underside of the boat in four different regions in order to clean the boat while conforming to the specific profile of the boat.

The automatic boat washing assemblies of the present invention may be installed in any desired waterway such as a lake, river, bay or ocean. For example, the boat washing assemblies may be installed at or near a marina or any other desired boat washing location. In one embodiment, the boat washing assembly may be fastened to a dock or other similar structure. In another embodiment, the boat washing assembly may be free-standing and anchored to the bottom of a lake, river, etc.

To provide safe utilization of the boat washing machine, the captain should be the only person on the boat as it goes through the machine—all other passengers should be on shore. The boat washing machine also requires a machine operator. After dropping off all passengers the boat captain lines up the bow of the boat to the inlet of the boat washing machine. Two flags may be mounted on the bow guides to provide navigational beacons for the captain. The captain navigates the boat between the beacons at idle speed. The bow guides are spring-loaded and will center the bow of the boat in to the cleaning position as the boat passes through them. As the boat enters the machine under idle boat power through the bow guides it will engage the rotary mid brush assembly. Such engagement may activate a "boat in-place" indicator on the control cabinet 80. The operator may then instruct the captain to secure all drives and trim all submerged components such as stern drives and trim tabs. The operator also inspects the boat and boat washing machine to ensure that nothing such as mooring lines are over the side which could be caught in the rotating brushes.

The cleaning operation begins once the captain has secured and trimmed all components and the operator has inspected the boat and cleaning machine. The operator presses a "start sequence" button on the control panel 80 and the cleaning operation begins.

The hydraulically driven winch 81 raises the movable cage 30 until the pneumatic wheels of the keel drive assemblies 37 engage the keel of the boat. Once the appropriate pressure is reached by the keel drive assemblies 37, the keel drive wheels start to rotate forward and move the boat. The ballast tank 29 in the cage 30 may be filled or emptied to provide tilt compensation for the assembly when the center of gravity of the cage 30 changes as a boat passes through the wash cycle.

Once the keel drive assemblies begin to move the boat, the rotary brush assemblies 40, 50, 51, 60, 61, 70 and 71 are rotated and contact the boat as it travels through the assembly. In the embodiment of FIGS. 1-4, the keel brush assembly 40 with its brushes 42 and the opposing mid brush assemblies 50 and 51 with their brushes 52 are the first brushing assemblies encountered. The keel brushes 42 clean the keel of the boat, and the mid brushes 52 clean an area from the waterline to mid-way to the keel. The mid brush assemblies 50 and 51 pivot toward the boat hull and their brushes 52 press against the hull under the force of the gas-assisted springs 56.

The next set of brushes encountered are the rotary bow brush assemblies 60 and 61 and their brushes 62. The bow brushes 62 are pivoted forward to conform to the bow and as the boat moves forward. The gas-assisted springs 66 press the bow brushes 62 against the hull to clean an area below the rotary mid brush assembly and above the boat keel area.

The last set of brush assemblies are the waterline assemblies 70 and 71. The waterline brushes 72 clean above the waterline and an area below the waterline down to the mid area. The rotary waterline brush assemblies 70 and 71 are attached to gas springs to allow conformity to the shape of the boat.

After the waterline brushes have cleaned the waterline and have cleared the stern of the boat, the winch 81 lowers the movable cage 30 back to the rest position and the boat will be clear of the boat washing machine and can re-engage and re-trim all drives and accessories. The cleaning operation is complete and the boat can leave under its own power.

The alternative embodiment shown in FIGS. 16-18 operates in a similar manner as the embodiment of FIGS. 1-4. However, after the bow brush assemblies 160 and 161 are encountered, the boat encounters the fixed keel brush assemblies 140 and 141. The keel brush assemblies are non-rotating and are attached to the one or two last pairs of keel drive wheel mounts 37. These non-rotating brushes clean the keel as the boat is moved across them. The keel brushes may adjust to the boat draft angle using gas springs.

Additional features include an emergency stop wherein the operator can immediately shut down the system with one switch in the event of any problem. A system reverse may be included, wherein the operator can run any or all sub-systems in reverse at any time from the control panel. Furthermore, a maintenance position may be provided, wherein the system has a maintenance switch, which will raise the birdcage above the waterline and thus expose all sub-systems. This will allow for cleaning and maintenance as necessary.

Whereas particular embodiments of this invention have been described above for purposes of illustration, it will be evident to those skilled in the art that numerous variations of the details of the present invention may be made without departing from the invention as defined in the appended claims.

The invention claimed is:

1. An automatic boat washing assembly comprising:

a main frame including side frames having at least one generally vertical guide member;

a movable cage located between the side frames and contacting the at least one generally vertical guide member, wherein the height of the movable cage with respect to the main frame is adjustable;

a plurality of brush assemblies mounted on the movable cage structured and arranged to contact and clean a boat as it passes through the boat washing assembly; and a plurality of keel drive assemblies mounted on the movable cage structured and arranged to contact a keel of the boat and to move the boat through the boat washing assembly wherein the plurality of keel drive assemblies are driven by a single motor.

2. The automatic boat washing assembly of claim 1, wherein the main frame comprises a base frame connected to lower ends of the side frames.

3. The automatic boat washing assembly of claim 1, further comprising a ballast tank mounted on each of the side frames.

4. The automatic boat washing assembly of claim 1, wherein each of the side frames comprises at least two of the generally vertical guide members.

5. The automatic boat washing assembly of claim 1, further comprising a winch mounted on the main frame for raising and lowering the movable cage.

6. The automatic boat washing assembly of claim 1, wherein the movable cage comprises a lateral section including lateral arms extending toward the side frames, and a longitudinal section extending along an axial length of the boat washing assembly.

7. The automatic boat washing assembly of claim 6, wherein each of the lateral side anus includes at least one cam follower for engaging the generally vertical guide members of the main frame.

8. The automatic boat washing assembly of claim 6, wherein the movable cage comprises a ballast tank for maintaining the movable cage in a substantially horizontal orientation.

9. The automatic boat washing assembly of claim 6, wherein the movable cage is vertically movable with respect to the main frame to a position above a waterline of the automatic boat washing assembly.

10. The automatic boat washing assembly of claim 1, wherein the plurality of brush assemblies comprise at least one keel brush assembly.

11. The automatic boat washing assembly of claim 1, wherein the plurality of brush assemblies comprise at least one mid brush assembly.

12. The automatic boat washing assembly of claim 1, wherein the plurality of brush assemblies comprise at least one bow brush assembly.

13. The automatic boat washing assembly of claim 1, wherein the plurality of brush assemblies comprise at least one keel brush assembly, mid brush assembly and bow brush assembly.

14. The automatic boat washing assembly of claim 1, further comprising at least one additional brush assembly mounted on the main frame.

15. The automatic boat washing assembly of claim 14, wherein the at least one additional brush assembly comprises a waterline brush assembly.

16. The automatic boat washing assembly of claim 1, wherein the brush assemblies comprise rotary disk brushes.

17. The automatic boat washing assembly of claim 16, wherein the brush assemblies are spring biased to force the rotary disk brushes against a bow of the boat.

18. The automatic boat washing assembly of claim 1, wherein the keel drive assemblies comprise multiple wheels positioned on opposing sides of a longitudinal axis of the movable cage.

19. The automatic boat washing assembly of claim 1, wherein the keel drive assemblies comprise multiple wheels positioned at different locations along a longitudinal axis of the movable cage driven by the motor.

20. The automatic boat washing assembly of claim 19, further comprising a drive belt drivingly engaged with the multiple wheels of the keel drive assemblies.

* * * * *

UNITED STATES PATENT AND TRADEMARK OFFICE

CERTIFICATE OF CORRECTION

PATENT NO. : 7,748,337 B2
APPLICATION NO. : 12/044305
DATED : July 6, 2010
INVENTOR(S) : Keith Doyle It is certified that error appears in the above-identified patent and that said Letters Patent is hereby corrected as shown below:

Claim 7 - Column 6, Line 54
"...anus..." should read "...arms...".

Signed and Sealed this
Fourth Day of January, 2011

David J. Kappos

David J. Kappos
*Director of the United States Patent and Trademark Office*